US005305812A

United States Patent [19]

Ferencsik

[11] Patent Number: 5,305,812

[45] Date of Patent: Apr. 26, 1994

[54] PROGRAMMABLE WOODWORKING DOVETAIL MACHINE

[76] Inventor: Robert P. Ferencsik, 164 E. Main St., Gloucester, Mass. 01930

[21] Appl. No.: 27,255

[22] Filed: Mar. 5, 1993

[51] Int. Cl.[5] ..... B27B 1/00

[52] U.S. Cl. ..... 144/356; 144/2 R; 144/3 A; 144/8 S; 144/134 R; 144/371; 144/88; 269/37; 269/41; 269/188; 269/236; 409/80

[58] Field of Search ..... 144/1 R, 2 R, 3 R, 3 A, 144/3 B, 85, 87, 88, 134 R, 356, 371, 75, 82, 198 R, 203, 204; 409/80; 269/37, 41, 188, 236; 364/474.02, 474.03, 474.25

[56] References Cited

U.S. PATENT DOCUMENTS

| | | | |
|---|---|---|---|
| 2,747,627 | 5/1956 | Havlik | 144/85 |
| 3,272,244 | 9/1964 | Nemec | 144/87 |
| 3,547,171 | 12/1970 | Jacumin . | |
| 4,056,137 | 11/1977 | Morasch et al. . | |
| 4,422,488 | 12/1983 | Lacroix et al. . | |
| 4,632,160 | 12/1986 | Wright . | |
| 4,632,165 | 12/1986 | Stegherr . | |
| 5,094,282 | 3/1992 | Suzuki et al. | 144/356 |

OTHER PUBLICATIONS

"Joint-making jig requires no templates", *Woodshop News* (Apr. 1993), pp. T1, T5.

*Primary Examiner*—W. Donald Bray
*Attorney, Agent, or Firm*—Fish & Richardson

[57] ABSTRACT

A bench mounted machine allows an operator to produce both mating components for woodworking through and half-blind dovetails in workpieces suitable for case construction and drawer construction with computer controlled programmable flexibility to determine size and centerline spacing of pins and tails as well as half-pin widths. Symmetrical and asymmetrical through and half-blind dovetail configurations can be created without the use of guide templates or fixed spindle arrangements. Stationary workpieces are mounted vertically and horizontally above an automated two axis dovetail cutting means. Pins and tails for interlocking through and half-blind dovetail joints are milled in the ends of workpiece boards based upon operator input commands from a personal computer control station.

11 Claims, 13 Drawing Sheets

E
9
4
D
7V2
7V1
C
F
12
36
32

E
10

E
1
E

10
E

E
11
E

11
E
E
B
J

11
E

4
P'
11
7V2
7V1
F
12
10
37
33

PROGRAMMABLE WOODWORKING DOVETAIL MACHINE

BACKGROUND OF THE INVENTION

The invention relates to woodworking apparatus and methods for making dovetails.

The dovetail joint is one of the most decorative and mechanically advantageous joints used in furniture making. By far, its most common and recognizable function has been in joining the corners of wooden boxes for either case or drawer construction. Two types of dovetails are generally employed for this purpose: through and half-blind or lap dovetails. The through dovetail is most often associated with casework construction, like that seen in a traditional blanket chest. The half-blind dovetail is thought of as a drawer joint. However, half-blind dovetails are also very important in the construction of cases when used as a substitute for through dovetails. Detailed descriptions of both of these joints are included in the preferred embodiment of the invention.

Hand cut through and half-blind dovetails are very time consuming and expensive to produce, but because of their widespread desirability and association with high quality furniture construction, many machines and hand held router jigs have evolved which attempt to duplicate their look with some degree of production efficiency. Presently, there is no machine specifically designed to cut a through dovetail like that described in this disclosure, although many purport to do so. The machines that do exist cut half-blind dovetails and are used for mass producing drawers. It is important to note that because of the method of operation of these machines, the resulting dovetail configurations have pins and tails of identical widths.

These machines offer no capability to vary the size and centerline spacing of pins and tails within the same dovetail configuration. There are hand held router jigs that will produce both through and half-blind dovetails as describe herein; however, these are strictly manual methods and cannot be considered machines, nor can they be used efficiently in a production environment.

The major drawback of all of these existing systems is that they limit the woodworker/operator to dovetail configurations determined by a template/templates or a fixed spindle arrangement.

It is an objective of the present invention to provide a bench top system whereby through and half-blind dovetail configurations can be designed and efficiently produced in boards suitable for case and drawer construction without the use of guide templates or fixed spindle arrangements. Consequently, the present invention offers the operator the flexibility to cut the pin/tail configurations dictated by his furniture designs rather than requiring him to adjust his designs to fit the templates or spindle arrangements available.

SUMMARY OF THE INVENTION

According to the invention, a woodworking machine comprises vertical clamping means and horizontal clamping means supported by a housing and mounted upon a base plate. Beneath the housing and also mounted upon the base plate is a position table capable of x and y axis linear motion. A router cutting means is mounted atop the x-y table. The housing and clamping means are capable of supporting boards ranging in size and thickness from those suitable for very small boxes to those used in large casework. The vertical and horizontal clamping surfaces of the housing, together with the clamping means, keep the workpiece boards suspended above the router. In this manner, the cutting means is free to move about in the x-y planes beneath the workpiece boards with proper orientation to perform a wood milling function on the ends of the boards. The cutting means can be adjusted to the proper height in the z direction to make contact with the workpiece boards by manually rotating the router housing.

In conjunction with accomplishing a primary objective of this machine, stopping means are provided to support the ends of the boards for each joint cutting operation so that efficient production run setups can be established. Adjustable stops for vertically and horizontally mounted workpieces provide accurate physical limits without interfering with the movement of the cutting means so that, at the end of each cutting cycle, finished work can be removed and new workpieces can be inserted in identical positions for precise repeatability.

DESCRIPTION OF THE PREFERRED EMBODIMENTS

Figure 1:
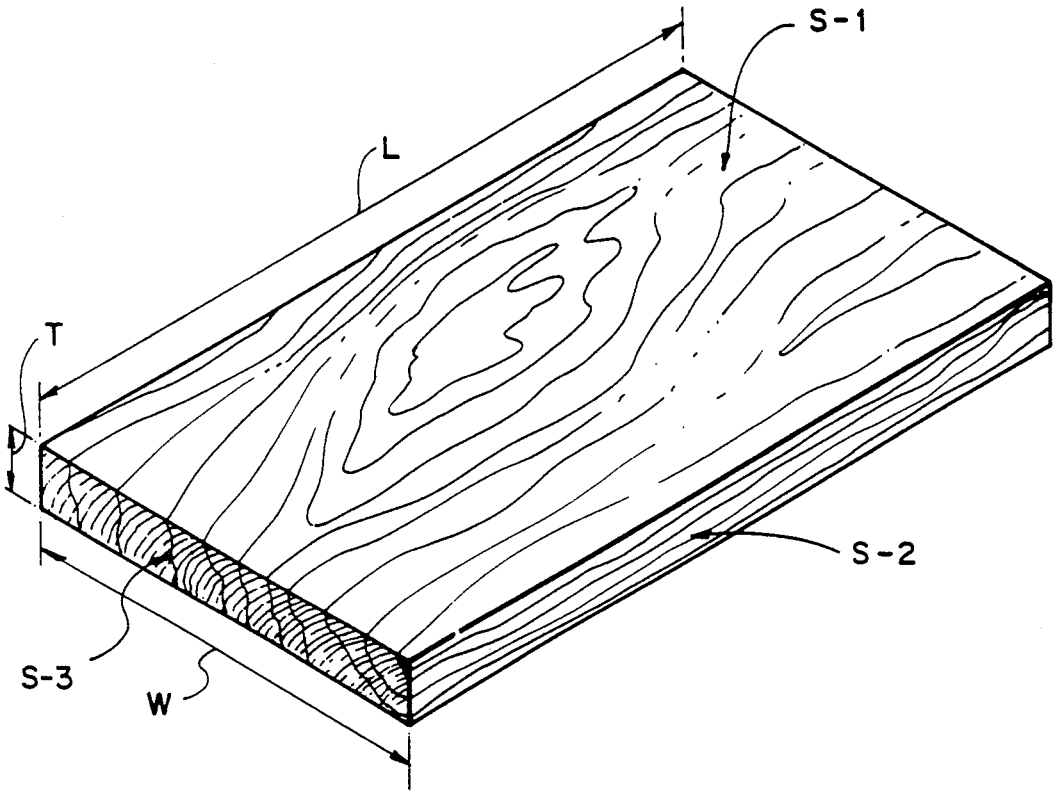
FIG. 1 is an isometric view of a typical workpiece board.

Referring now to the drawings, FIG. 1 identifies workpiece dimension terminology for the purposes of this discussion. The information indicated in FIG. 1 is included so that definitions that follow will be easily understood and any confusion between length, width, and thickness, or end, face, and edge grain can be avoided. Referring now to FIG. 1, dimension L, shown running in a direction parallel to the grain of the workpiece, shall designate workpiece length; dimension W, running in a direction perpendicular to the grain of the workpiece, shall designate workpiece width; the shortest remaining dimension, T, shall designate workpiece thickness. The surfaces S-1, S-2, and S-3 designate face grain, edge grain and end grain of the workpiece board, respectively. All references hereafter to workpiece or joint length, width and thickness, or face grain, edge grain and end grain will adhere to the convention depicted by FIG. 1.

FIGS. 2 through 5 are isometric views of the woodworking joints produced by the apparatus and method of the present machine. Additionally, for the purposes of this disclosure, the following definitions are provided:

1) TAIL: That portion of the interlocking joint in which the dovetail/fan shape can best be seen on a surface running with the grain of the board to which it is integral.

2) PIN: That portion of the interlocking joint in which the dovetail/fan shape can best be seen on the end grain surface of the board to which it is integral.

3) THROUGH DOVETAIL: Dovetails such that the end grain of the tail portion of the joint projects completely through the board it is being joined to and can be seen. This end grain projection will be rectangular.

4) HALF-BLIND DOVETAIL: Dovetails such that the end grain of the tail portion of the joint does not project through the board it is being joined to and cannot be seen.

5) TAILBOARD: The board in which the tails have been cut.

6) PINBOARD: The board in which the pins have been cut.

7) HALF-PIN: It is mechanically advantageous and generally accepted practice to leave one half-pin on either side of a complete dovetail configuration. Half-pins are located on the outside edges of the pin board. One side of the half-pin will be angled to accept the tails of the tail board, and its other side will be the edge of the board to which it is integral.

8) HALF-PIN WIDTH: The smallest dimension of the half-pin measured in a direction perpendicular to the grain of the pin-board.

9) DOVETAIL WIDTH: The largest dimension of the tail measured in a direction perpendicular to the grain of the tail board.

10) PIN WIDTH: The smallest dimension of the pin measured in a direction perpendicular to the grain of the pin board.

It is the purpose of FIGS. 2 through 5, in conjunction with the above definitions, to properly identify the important component parts of each joint produced by the method of the present machine.

Figure 2:
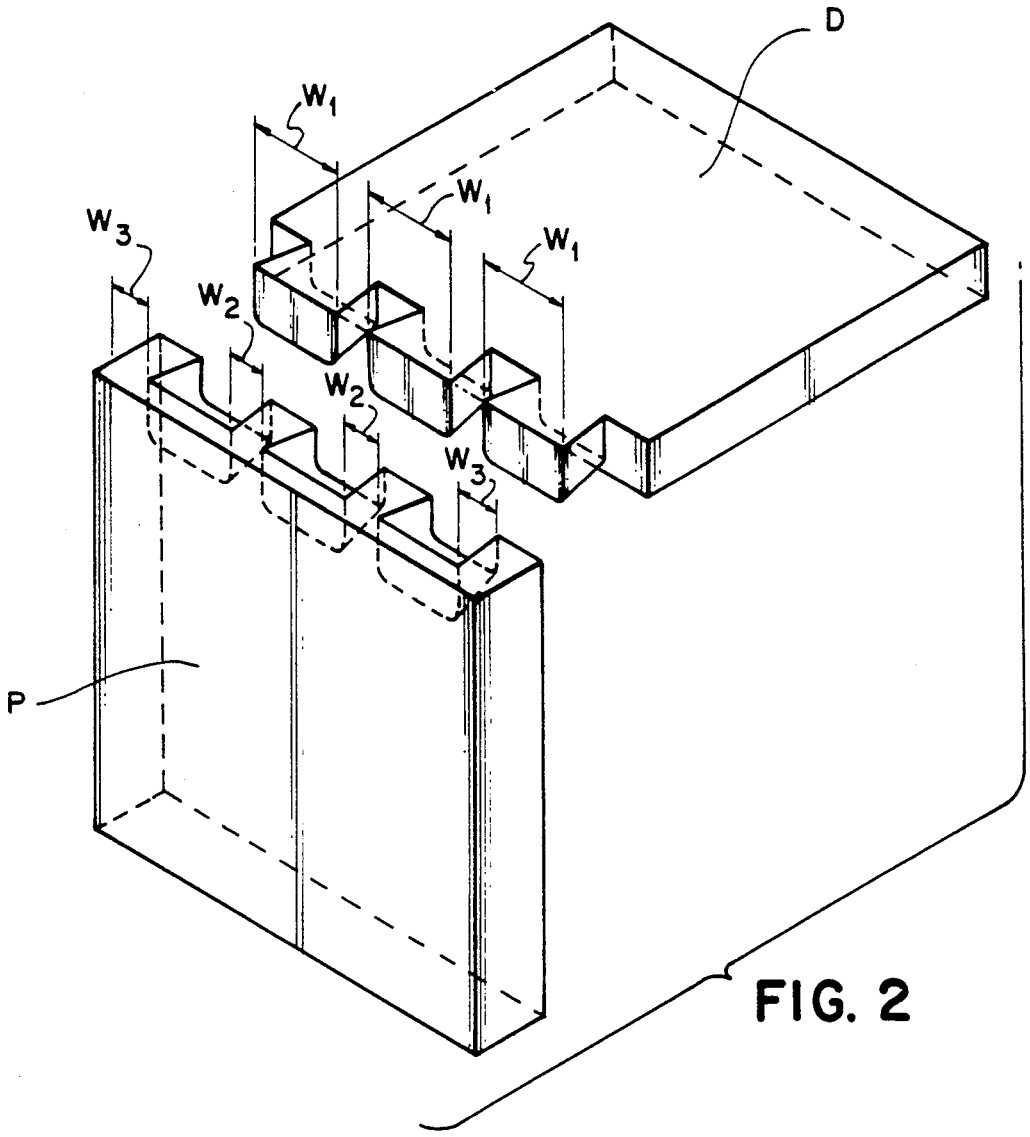
FIG. 2 is an isometric view of an open half-blind dovetail joint symmetric about the workpiece centerline as produced by the present invention.

FIG. 2 depicts both mating parts of a typical symmetrical half-blind dovetail configuration. In accordance with the above definitions, and with reference to FIG. 2, workpiece D is the tailboard of the joint, where W is the dovetail width. Three dovetails with width W1 are shown. Workpiece P is the pinboard of the joint, where W2 is the pin width, and W3 is the half-pin width. Two pins with width W2 and two half-pins with width W3 are shown. Note that in FIG. 2, the bottoms of the dovetails and the corresponding areas between the pins of the pin board are rounded. These rounded areas are caused by the rotation of a spinning dovetail shaped cutter. They pose no problem from an esthetic or construction standpoint. They are totally hidden when the joint is closed, and the rounded areas between the pins are end grain surfaces which, by definition, do not form structurally sound glue joints with other end grain surfaces or long grain surfaces when typical furniture-making glues are used. It is the mating of long grain to long grain surfaces that produces what is considered a glue joint.

Figure 3:
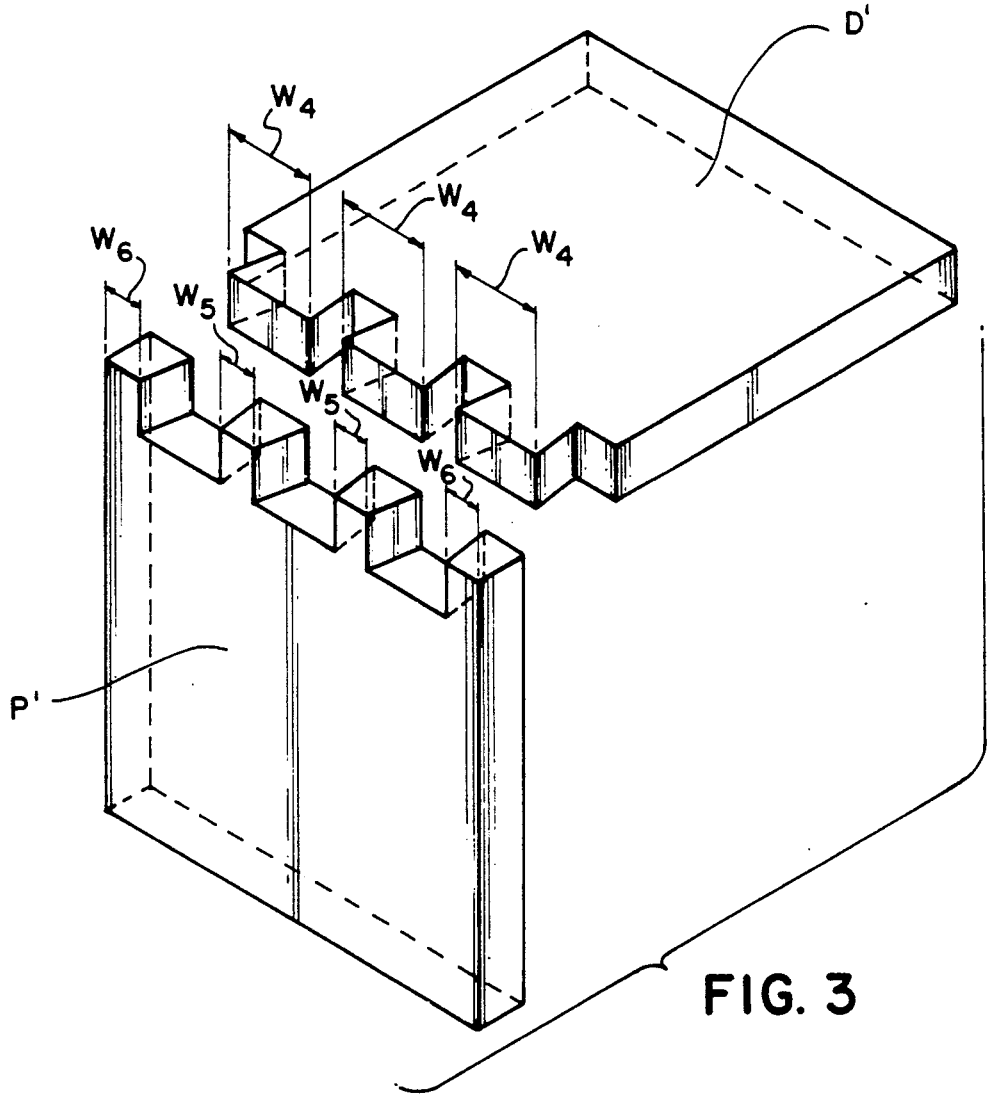
FIG. 3 is an isometric view of an open through dovetail joint symmetric about the workpiece centerline as produced by the present invention.

FIG. 3 depicts both mating parts of a typical symmetrical through dovetail configuration. Workpiece D' is the tailboard of the joint, where W4 is the dovetail width. Three dovetails with width W4 are shown. Workpiece P' is the pinboard of the joint, where W5 is the pin width, and W6 is the half-pin width. Two pins with width W5 and two half-pins with width W6 are shown.

Figure 4:
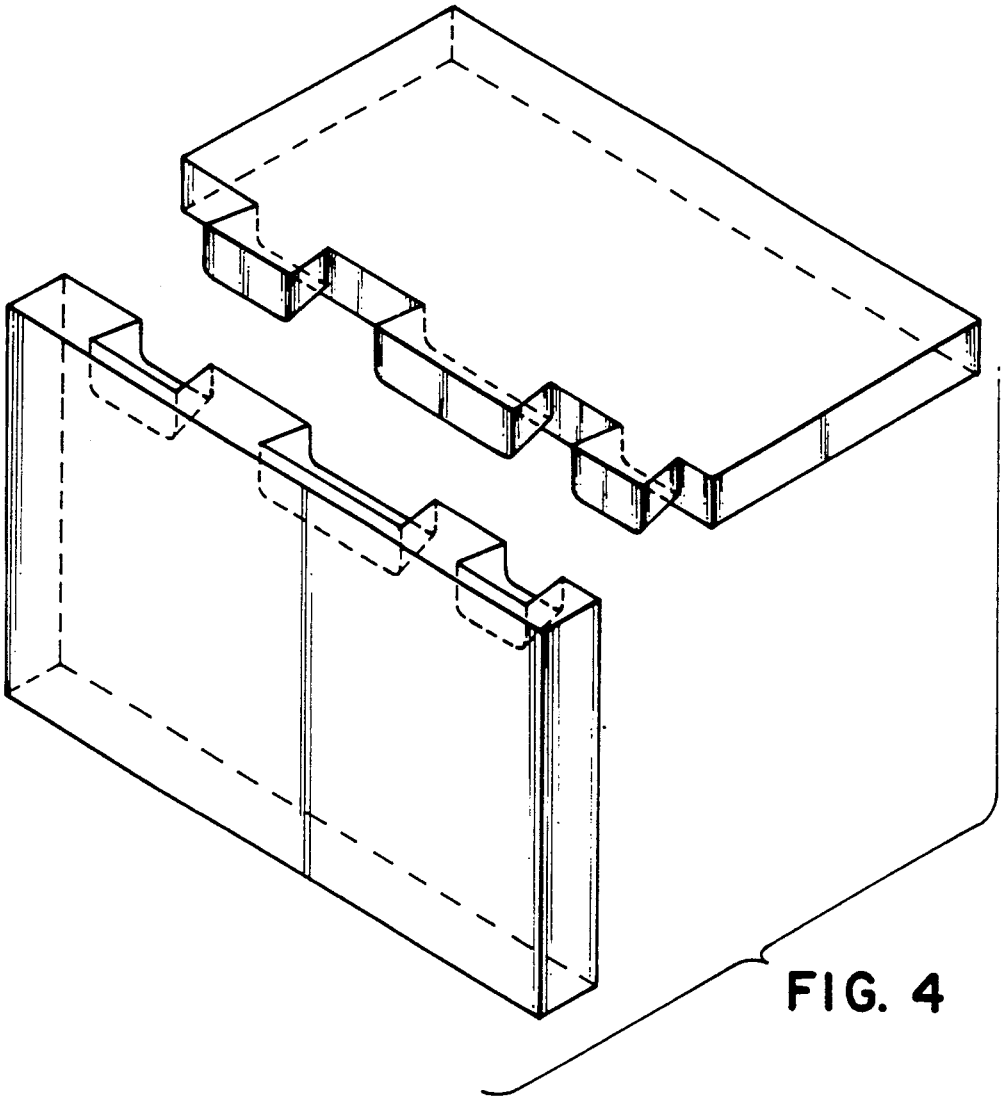
FIG. 4 is an isometric view of an open half-blind dovetail joint asymmetric about the workpiece centerline as produced by the present invention.
Figure 5:
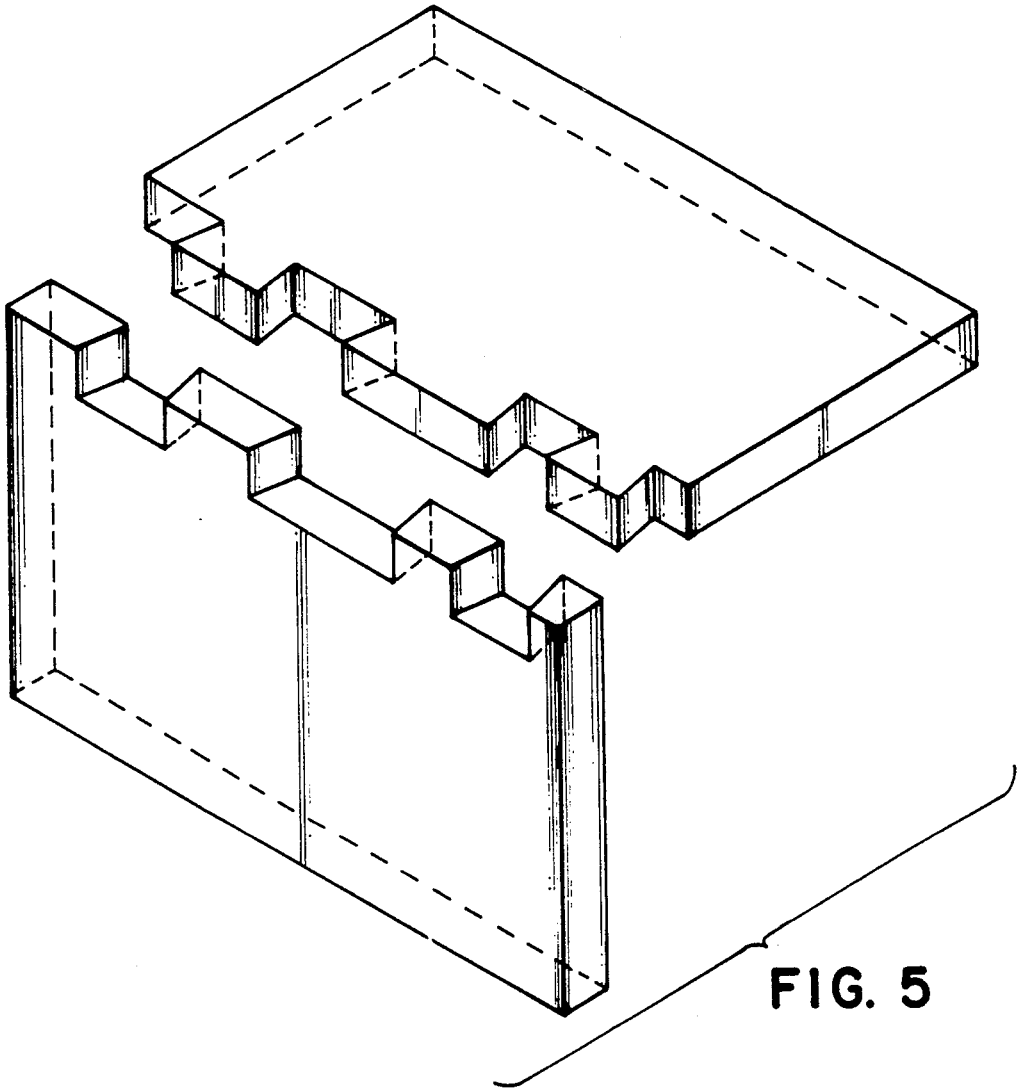
FIG. 5 is an isometric view of an open through dovetail joint asymmetric about the workpiece centerline as produced by the present invention.

FIGS. 4 and 5 depict asymmetrical equivalents of FIGS. 2 and 3. Note that in each drawing, dovetail widths, pin widths and half-pin widths occur at random, and there is no joint symmetry with respect to pin and tailboard centerlines. In other words, there are no repetitive patterns of pins and tails as in the configurations shown in FIGS. 2 and 3.

FIGS. 6 through 9 display the apparatus and operating method of the present machine. FIGS. 10 through 18C illustrate cutting path and stop operation methods for specific tail and pinboard situations. Symbols D, P, D' and P' used in FIGS. 2 and 3 to identify pinboards and tailboards for through and half-blind dovetails also identify workpiece boards in the figures that follow.

Referring now to these drawings, base plate 1 is the mounting platform for the structure and operating mechanisms of the machine. Uprights 2 mount upon the base plate and are located and supported by angled members 3. Spanning between and fastened to the uprights 2 are a vertical clamping surface 4, a horizontal clamping surface 5 and a stabilizing member 6. The components 2, 3, 4, 5 and 6 in combination form a housing capable of supporting vertically and horizontally mounted workpiece boards above a linear automated cutting means which travels beneath it.

T-slots 7V1 and 7V2 are milled into vertical clamping surface 4, and T-slot 7H is milled into horizontal clamping surface 5. These T-slots are best seen in side elevation FIG. 6 and in isometric FIGS. 10, 12, 14 and 17, but are also indicated in FIGS. 7-9 by hidden lines where appropriate. The T-slots support and provide a track for movement and subsequent locking of half-blind dovetail pinboard stopping means 8 (FIGS. 6, 7, 8, 10 and 11A-C), through and half-blind dovetail tailboard stopping means 9 (FIGS. 6, 7, 8, 12, 13A-C, 17 and 18A-C), and through dovetail pinboard stopping means 10 and 11 (FIGS. 9, 14, 15A–C and 16A–C). Double headed arrow F indicates the direction of stop movement (FIGS. 7, 8, 9, 10, 12, 14 and 17). Stop positions are adjustable to accommodate varying board widths and, in the case of tailboard stops, to avoid interference with cutting means travel. All stops lock within their respective T-slots by means of a screw and tapped washer and are held square by dual dowel pins. This locking method, and the movement of stops into and out of T-slots, is illustrated by the solid line isometric views of tailboard stops 9 with lock washers C and dual dowel pins E shown in FIGS. 12 and 17.

Each clamping surface has a stationary locating strip mounted upon it to provide a physical zero point reference position for the workpiece boards. Reference strip 12 on the vertical clamping surface is indicated on FIGS. 7, 8, 9, 12, 14 and 17; and reference strip 13 on the horizontal clamping surface is shown on FIGS. 7, 8 and 10. Clamp housing blocks 14H and 14V fasten to the uprights 2 and support vertical and horizontal mechanical clamping means consisting of eccentric shafts 15H and 15V, bearing strips 16H and 16V, bolt-spring-washer-nut combination 17H and 17V and handles 18H and 18V (FIGS. 6, 7, 8 and 9). These eccentric cam clamps in conjunction with the stopping means and physical reference strips provide a system through which workpiece boards can be accurately positioned and efficiently retained during cutting operations. It is recognized that eccentric cam clamps are but one method of properly securing the workpiece for cutting operations, and that other appropriate means could be substituted and work effectively in concert with the stopping system discussed herein.

Referring now to FIGS. 6 through 9 only, the cutting means and mechanized portion of the present invention will be described.

Mounted upon base plate 1, and beneath the vertical and horizontal clamping system discussed above, is a router cutting means 31 (e.g. Porter Cable Model #75361, 3 hp) carried by a position table capable of x and y axis linear motion. The position table consists of a y-direction linear stage mounted upon an x-direction linear stage. Except for length of travel, construction of the two stages is virtually identical. The construction of each stage includes four shaft supports 19 that support two shafts 20 over which ride bushing blocks 21. The bushing blocks for each stage fasten to plates 22 which provide mounting surfaces for the next stage. The shaft supports of the lower x stage mount to the base plate 1, the shaft supports for the y stage mount upon the x stage, and the y stage plate provides a surface upon which the router cutting means can mount. Movement of the two stages is accomplished by stepper motor lead screw electro-mechanical operation. Bushing blocks 23 carrying nuts 24 through which lead screws 25 can thread are fastened to the bottom of each plate 22 between the bushing blocks that ride over the shaft supports. Lead screw shaft supports 26 support the ends of each lead screw, and motor mounts 27 support stepper motors 28. Computer controlled commands energize the stepper motors which rotate the lead screws and, subsequently, move the stages of the position table. Router uprights 29 mount atop the y stage of the position table and support router face plate 30. The router cutting means is fastened through the face plate, and is, thereby, supported as it is carried along by the controlled movements of the x-y position table below it.

Figure 6:
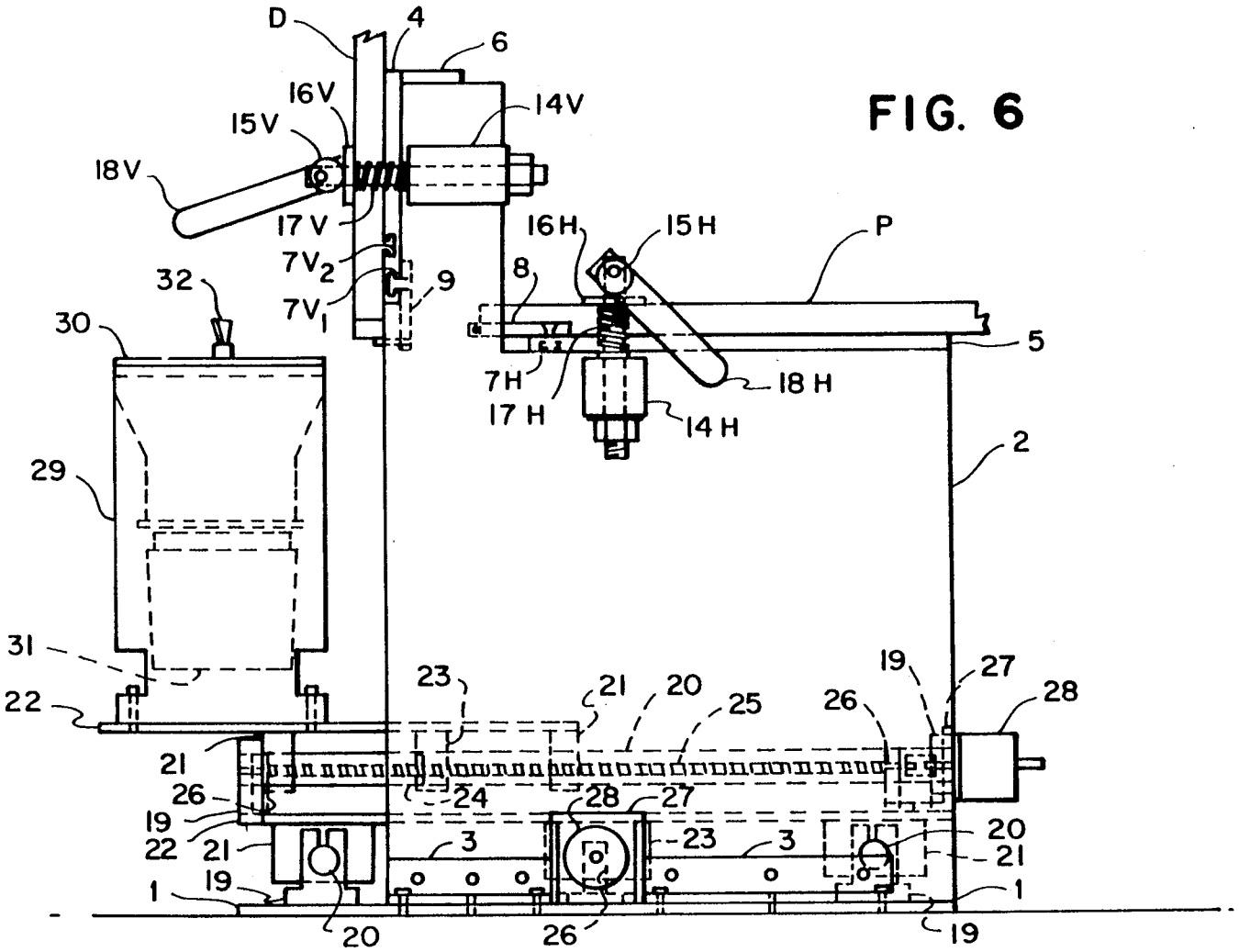
FIG. 6 is a side elevation of the apparatus configured for half-blind dovetail production.
Figure 7:
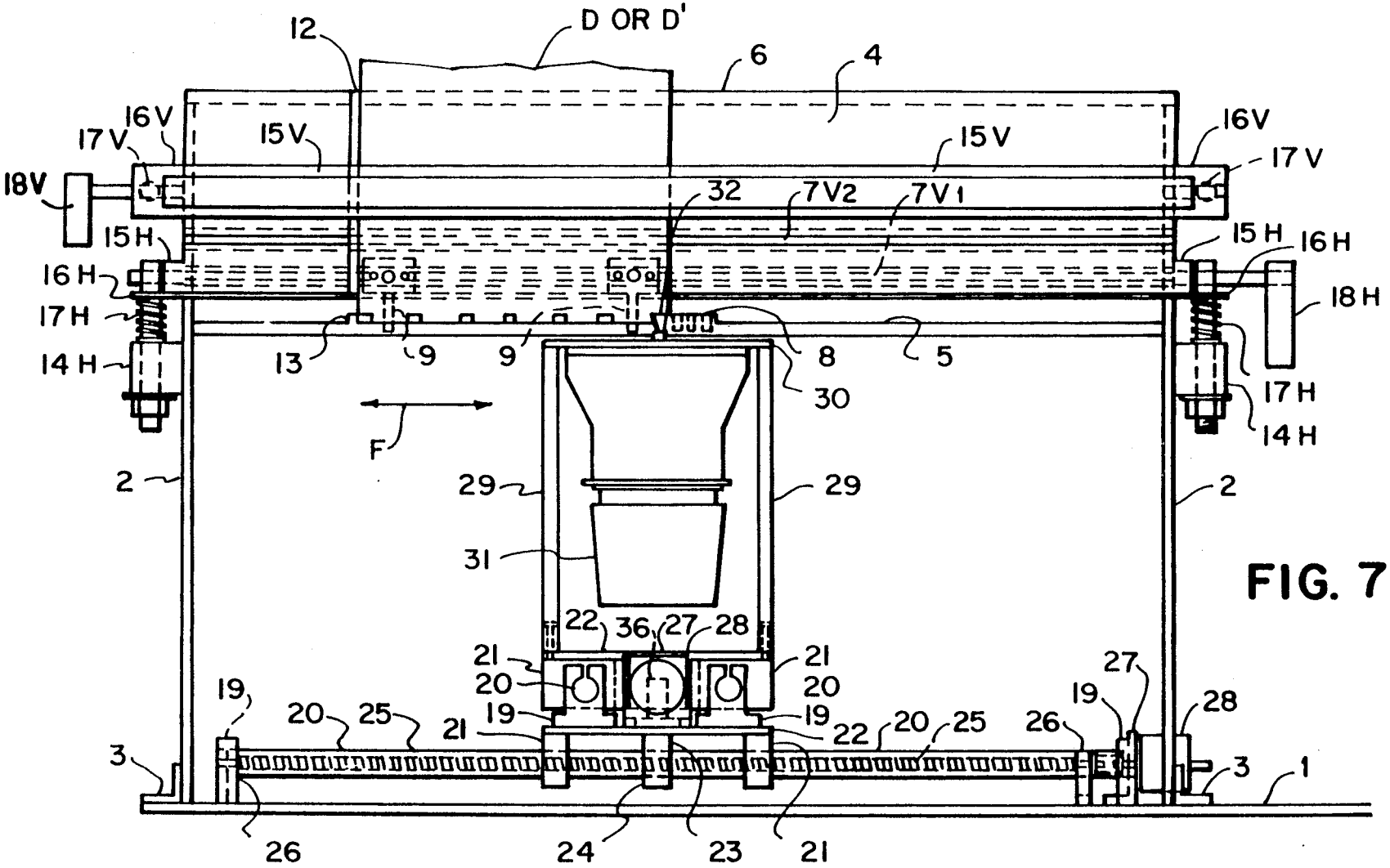
FIG. 7 is a front view of the apparatus and setup shown in FIG. 6 (because of the method of the apparatus, this figure also depicts a front view of a through dovetail tailboard production setup).
Figure 8:
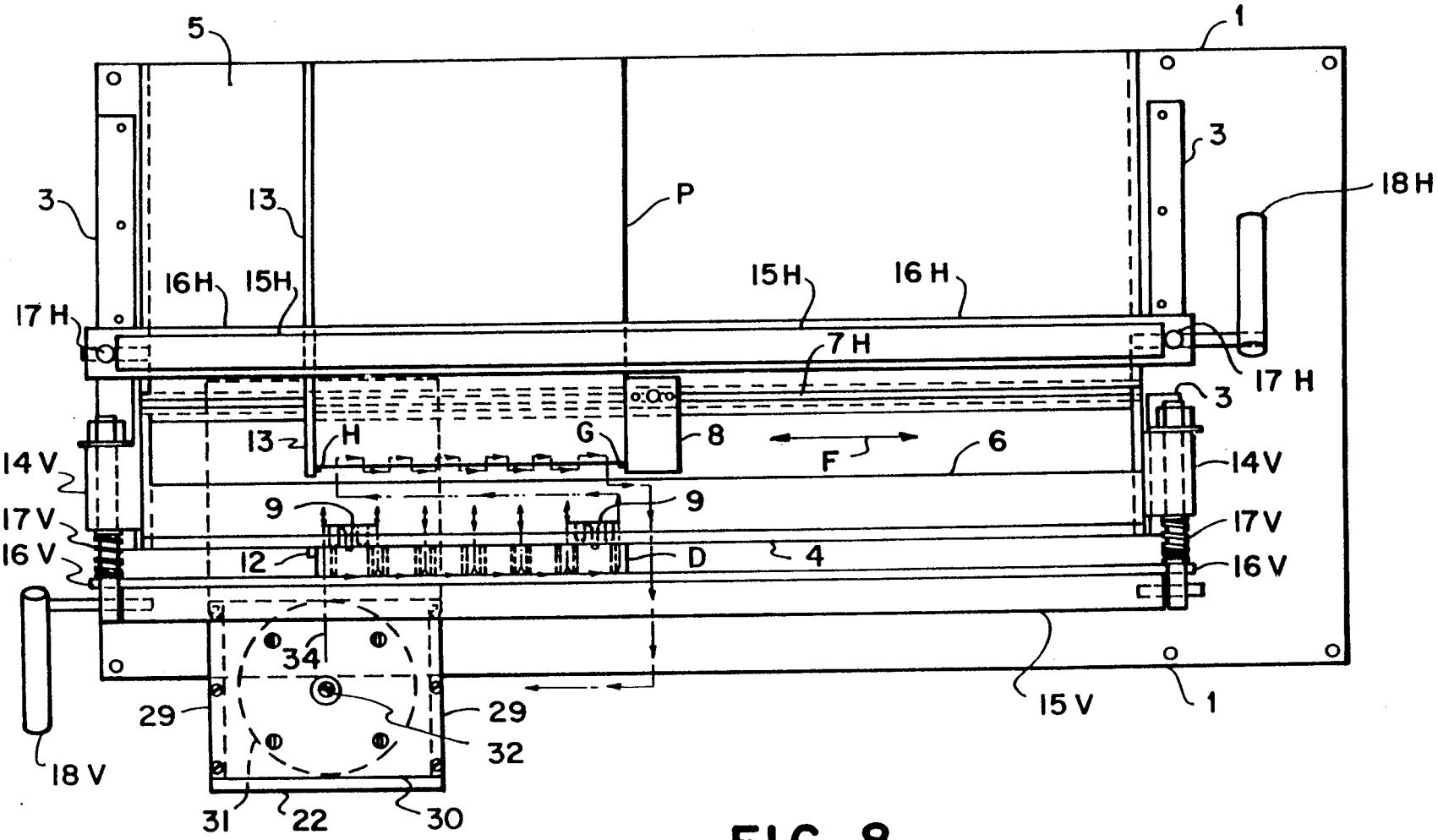
FIG. 8 is a diagrammatical plan view of the setup shown in FIGS. 6 and 7, with cutter path for half-blind dovetail production indicated.
Figure 9:
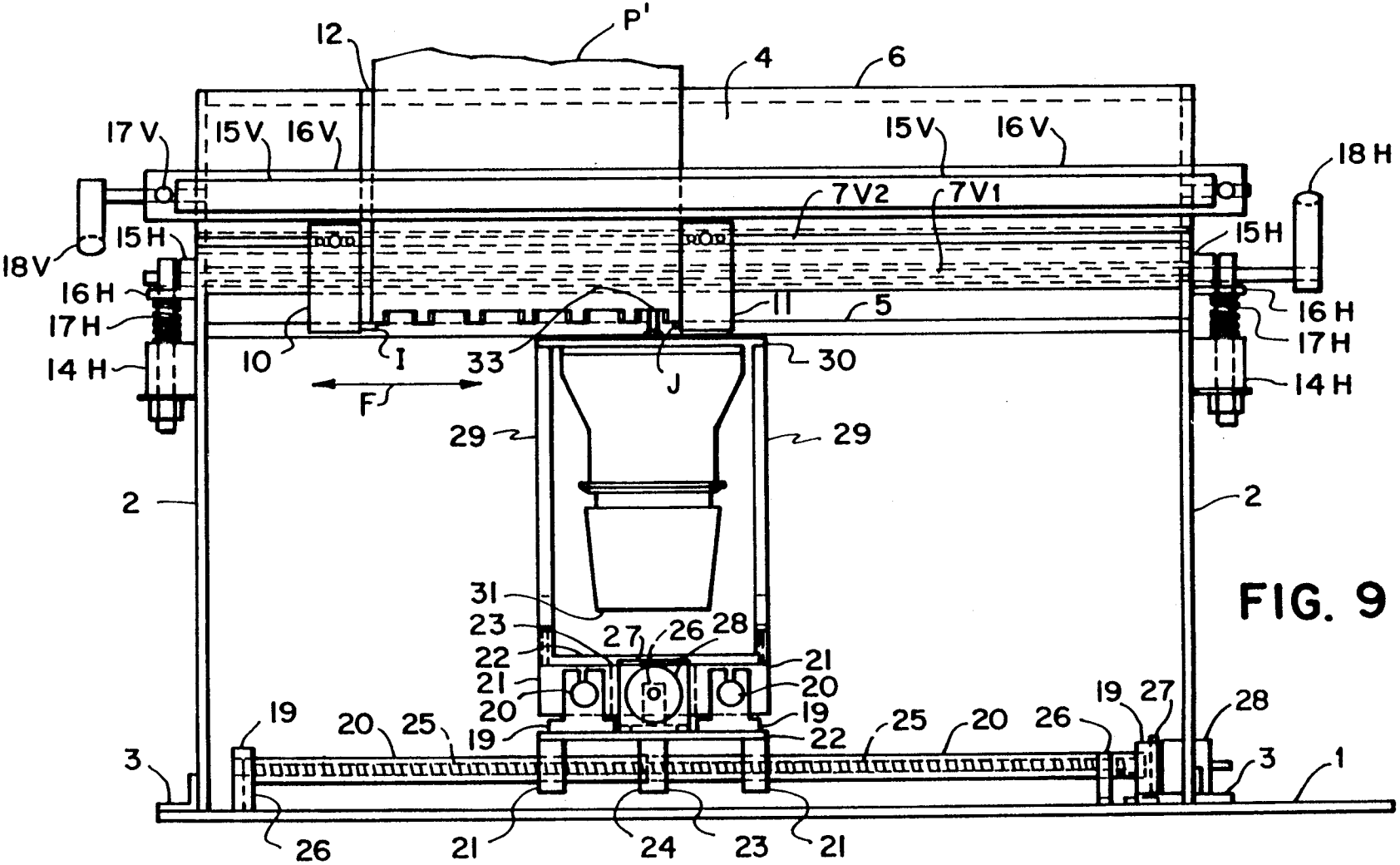
FIG. 9 is a front view of the apparatus configured for through dovetail pinboard cutting.
Figure 10:
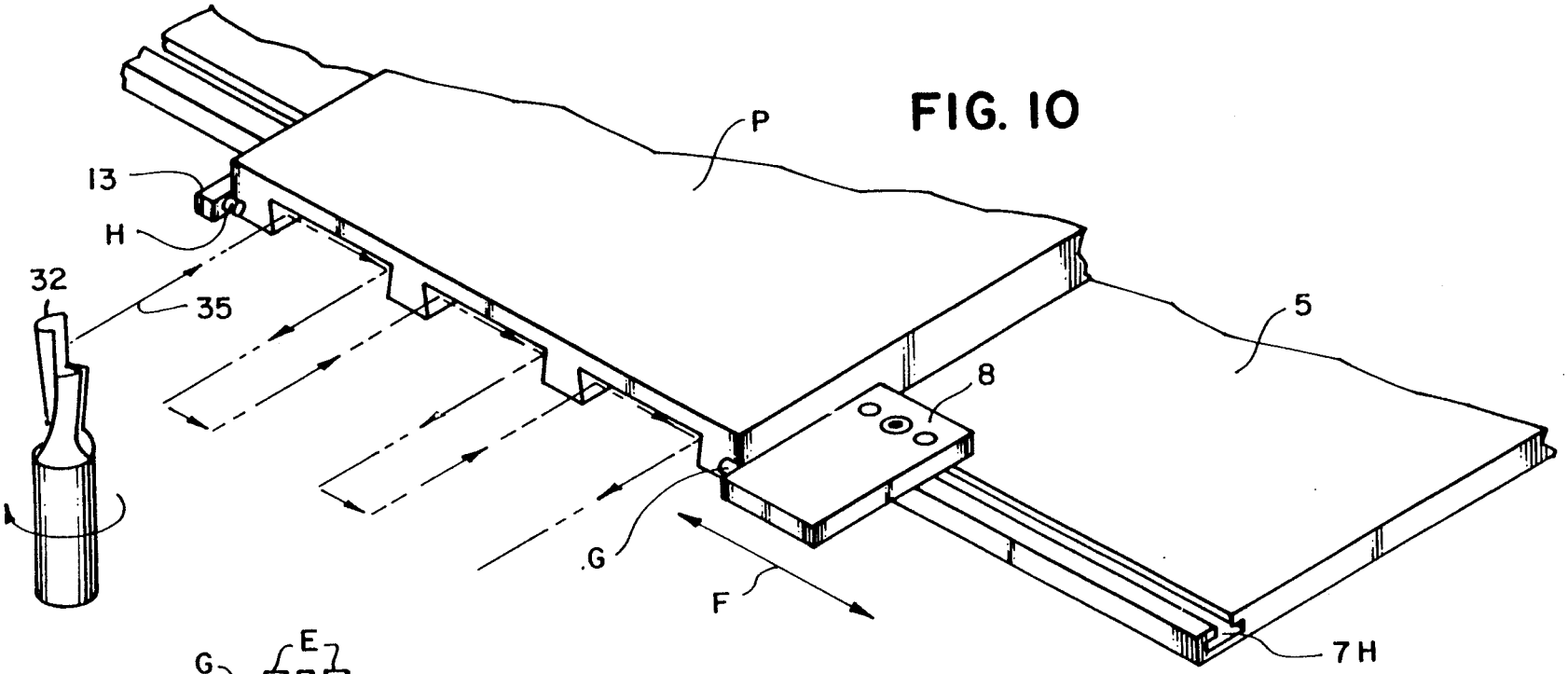
FIG. 10 is an enlarged isometric view of a half-blind dovetail pinboard production run setup.
Figure 11B:
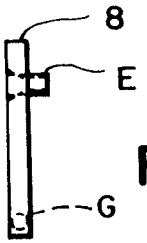
FIGS. 11A, 11B and 11C show front, side and plan views, respectively, of the half-blind dovetail pinboard stop.
Figure 11C:
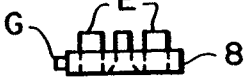
Figure 11A:
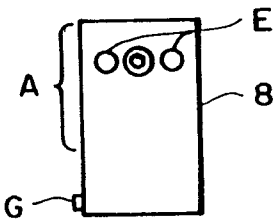
Figures 12, 13A, 13B, 13C:
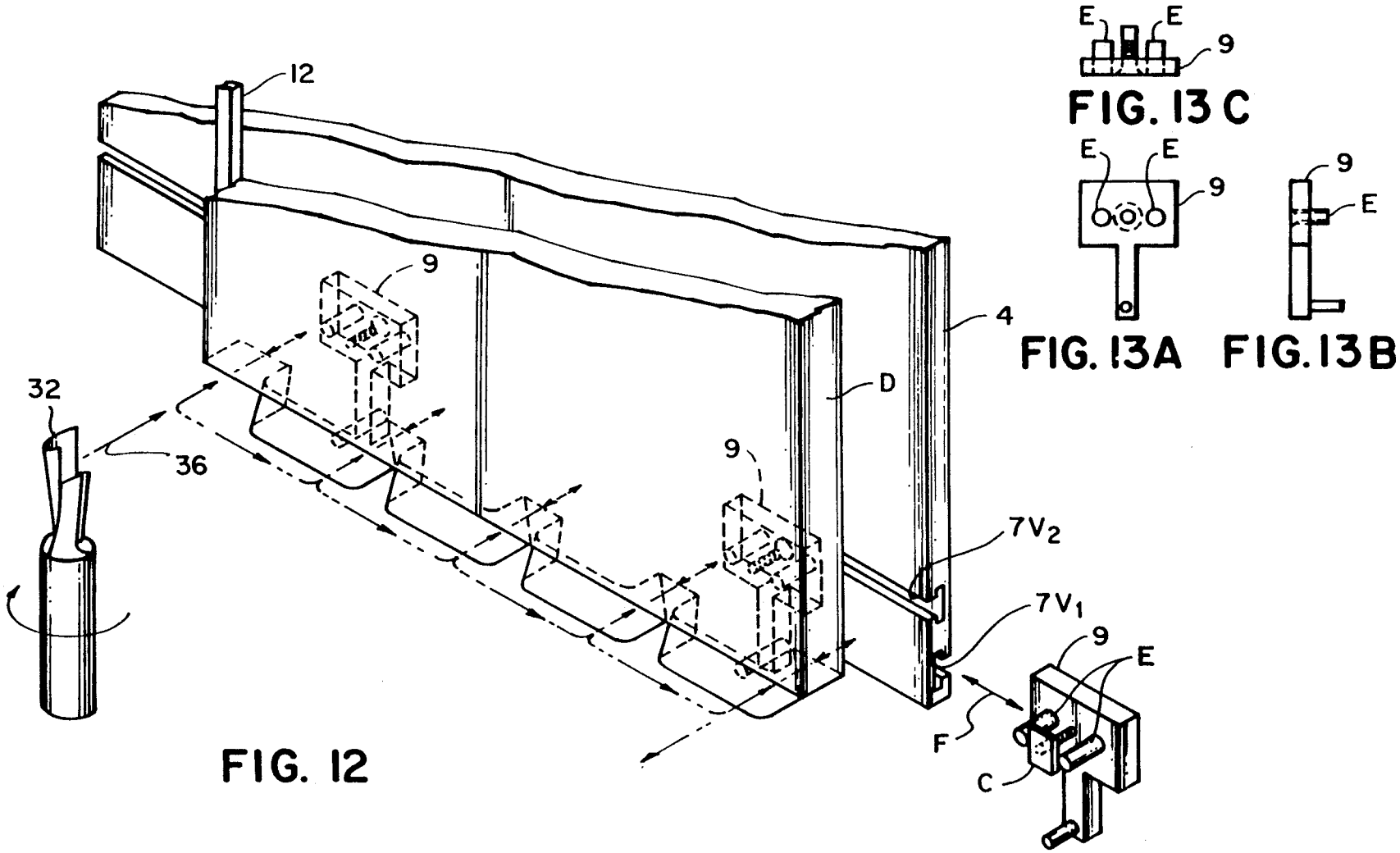
FIG. 12 is an enlarged isometric view of a half-blind dovetail tailboard production run setup.
FIGS. 13A, 13B and 13C show front, side and plan views, respectively, of the half-blind dovetail tailboard stops (identical to FIG. 18A, 18B and 18C).

FIGS. 6, 7 and 8 illustrate side, front, and plan elevations, respectively, of a half-blind dovetail production run setup. FIGS. 10 and 12 are exploded isometric views depicting cutter path and stop arrangements for this setup. In actual operation, workpiece tailboards D will be mounted against the vertical clamping surface, and workpiece pinboards P will be mounted against the horizontal clamping surface. If the operator has a preference as to which face of the workpiece boards face outward when the completed joint is closed, he is advised to place that face of the pinboard away from the horizontal clamping surface and that face of the tailboard against the vertical clamping surface.

The location of tailboard stops 9 will be adjusted so they do not conflict with the inward and outward movements of the dovetail cutting means (see FIG. 12). The operator will be advised of these locations by the computer.

Pinboard stop 8 will be adjusted and locked against the edge of the workpiece board, as indicated in FIG. 8 and best seen in FIG. 10. It should be mentioned here that stop 8 and reference strip 13 utilize short dowel pins G and H, respectively, which contact the Workpiece on its end grain surface such that half-pin widths as narrow as ¼ inch can be produced without interfering with the path of the cutting means. Specific details of the half-blind dovetail pinboard stop 8 and reference strip 13 are shown best in FIGS. 10 and 11A–C. Note that a portion of side A of the stop is relieved, so that when the workpiece board is confined between the stop and the reference strip 13, it will not be pinched. Consequently, finished workpiece boards can be easily removed and new ones inserted as production runs progress without unlocking and repositioning the stop.

With all of the stops locked in the proper positions and workpiece boards retained beneath the eccentric cam clamps, a computer program can be initiated based upon operator input commands which will execute the dovetail configuration displayed on the screen. For cutting both tails and pins for half-blind dovetails, a dovetail shaped bit 32 will be inserted in the router collet (FIGS. 6, 7, 8, 10 and 12). The position of the vertically mounted workpiece with respect to the horizontally mounted workpiece is such that, with a single manual height adjustment of the bit, only one program cycle need run to produce both pins an tails. FIG. 8 depicts the general cutting path 34 of the router during half-blind dovetail operations. FIGS. 10 and 12 are isometric enlargements of the specific pin and tailboard cutting paths, 35 and 36, respectively. Note that these cutting path examples are for symmetric dovetail configurations, and that some variation would occur for asymmetric configurations depending upon the spacing of pins and tails determined by the operator. FIGS. 11A–C and 13A–C are included to provide additional views of pin and tailboard stop details. The cutting means will proceed through the vertically mounted board in successive steps, as shown in FIGS. 8 and 12, to produce a series of tails with rounded bottoms. After completing the last tail, it will travel behind the vertically mounted board and mill the rounded sockets of the horizontally mounted pinboard. At the completion of this cutting cycle, the cutting means will return to its home position, and the boards can be flipped and reinserted so the program cycle can be repeated on their opposite ends.

Figures 14, 15A, 15B, 15C, 16A, 16B, 16C:
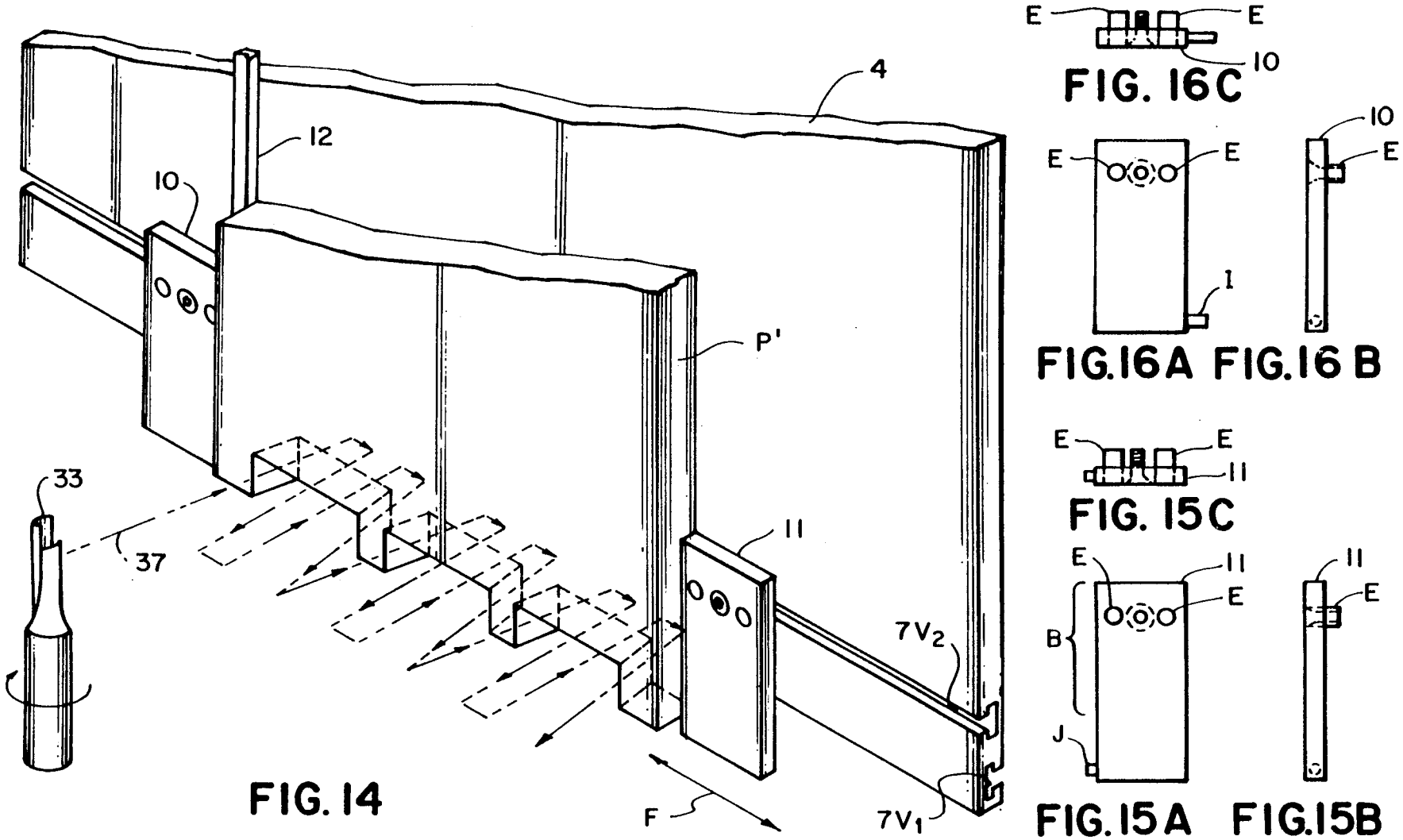
FIG. 14 is an enlarged isometric view of a through dovetail pinboard production run setup.
FIGS. 15A, 15B and 15C show front, side and plan views, respectively, of the right hand through dovetail pinboard stop.
FIGS. 16A, 16B and 16C show front, side and plan views, respectively, of the left hand through dovetail pinboard stop.
Figures 17, 18A, 18B, 18C:
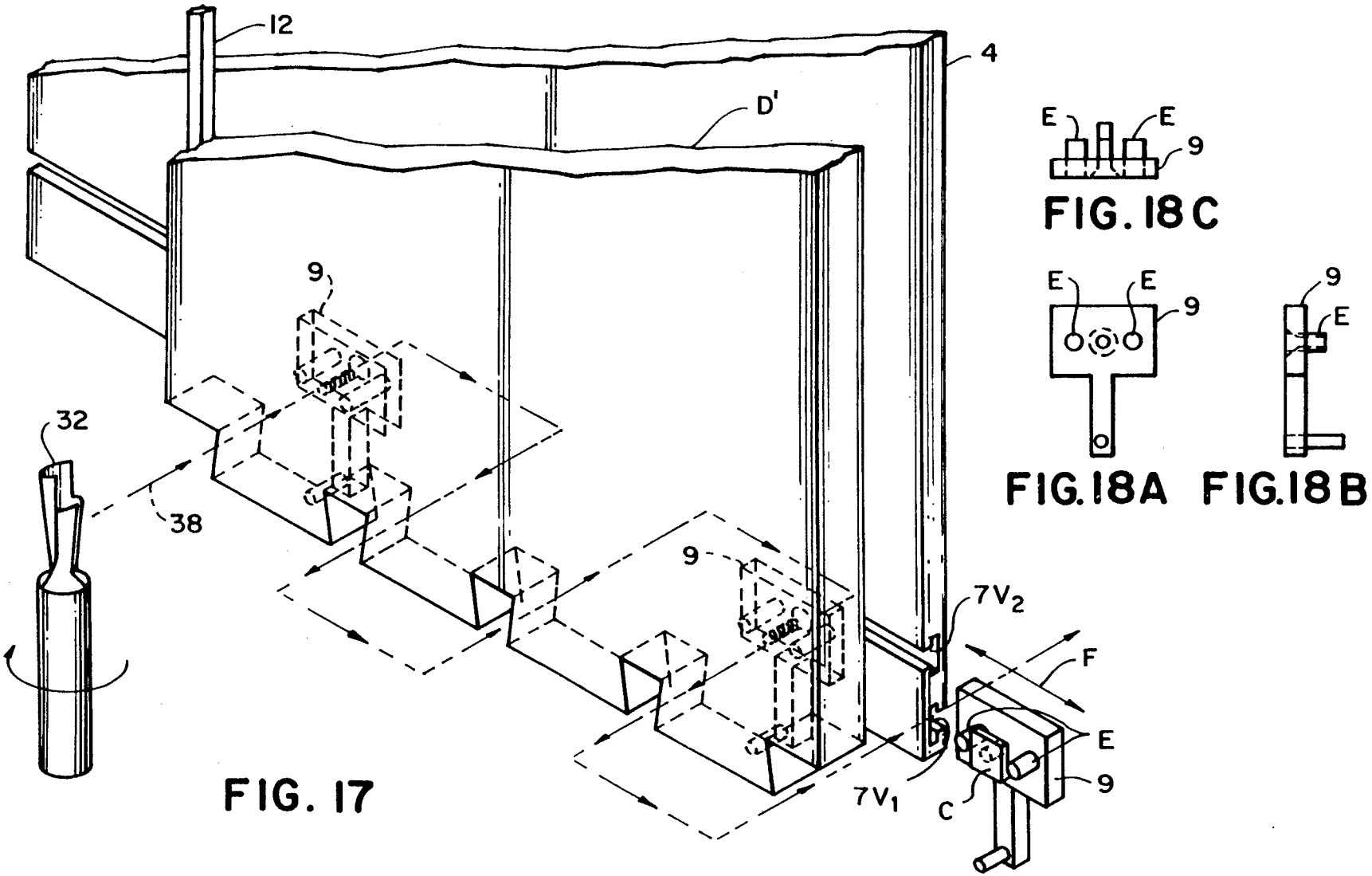
FIG. 17 is an enlarged isometric view of a through dovetail tailboard production setup.
FIGS. 18A, 18B and 18C show front, side and plan views, respectively, of the through dovetail tailboard stops (identical to FIGS. 13A, 13B and 13C).

FIGS. 7 and 9 illustrate front elevations of through dovetail production run set ups. FIGS. 14 and 17 are isometric enlargements of the specific pin and tailboard cutting paths 37 and 38, respectively. Once again, to facilitate this explanation, the cutting paths depicted are for symmetrical dovetail configurations. Unlike with half-blind dovetails, all through dovetail cutting operations are performed on vertically mounted workpiece boards. Tailboards and pinboards are cut in separate operations. Workpiece tailboards are clamped, and tailboard stops are adjusted and locked in the same manner as described above for half-blind dovetails (see FIGS. 17 and 18A–C). Tailboard stops depicted in FIGS. 12, 13A–C, 17 and 18A–C for through and half-blind dovetails are identical. Redundant views are included to facilitate inspection of the various figures.

Cutting of tails utilizes a dovetail shaped bit 32 manually adjusted so that the tail length will correspond to the thickness of the mating pinboard. Through dovetails do not require that tail bottoms be rounded, so the path of the cutting means is slightly different than that described for half-blind dovetails (see FIG. 17).

The nature of the through dovetail joint and the method of the present invention does not dictate a clear convention, as with the half-blind dovetail joint, as to which face of the workpiece boards, the outward or inward when the resulting joint is closed, should contact the vertical clamping surface. Consequently, to allow the operator to exercise any preferences he may have in this regard, a convention was adopted, and the software was written with the assumption that the faces of the pin and tailboards that will point inward when the resulting joint is closed are placed against the vertical clamping surface during cutting operations. As previously described, joint layout will be designed and executed from the computer screen.

Through dovetail pinboards will also be cut utilizing the vertical clamping surface (see FIGS. 9 and 14). Left and right through dovetail pinboard stops 10 and 11 will function in a similar manner to the half-blind dovetail pinboard stop 8 and horizontal reference strip 13 explained above. The stops ride and lock into the upper T-slot 7V2 of the vertical clamping surface 4 and stabilize and properly locate workpiece boards for cutting operations. The left hand stop is located against the vertical reference strip 12, and the right hand stop is positioned against the board edge. Left hand stop 10 employs short dowel pin 1, and right hand stop 11 employs short dowel pin J, which contact the end grain surface of the workpiece board such that half-pin widths as narrow as ¼ inch can be produced without interfering with the path of the cutting means (see FIGS. 9, 14, 15A–C and 16A–C). As with the half-blind dovetail pinboard stop 8, a portion of side B of the right hand through dovetail pinboard stop 11 is relieved, so that when the workpiece board is confined between the stop and the reference strip, it will not be pinched and can be easily removed without unlocking and repositioning the stops. Through dovetail pinboard stop details are depicted in FIGS. 14, 15A–C and 16A–C.

A straight cutter 33 is utilized to mill the through dovetail pins (FIGS. 9 and 14). Its height is manually set so that the length of the pins correspond to the thickness of the mating tailboard. FIG. 14 illustrates the cutting path 37 of the cutting means when producing through dovetail pins. Once again, joint layout will be designed and executed from the computer screen. It makes no difference which workpiece board is operated upon first, pinboard or tailboard.

In summary, for half-blind dovetail cutting, an operator inputs data to the computer relating to workpiece dimensions, router bit size and desired dovetail configuration specifics. With this information, the computer calculates joint layout, starting positions, tail board stop locations and the appropriate cutting paths. The operator adjusts the router bit height to a distance above the horizontal clamping surface equal to the preferred dovetail length. This length is determined by the lap the operator wishes to leave in the pinboard. The operator places the pinboard, workpiece P, inside face down, on the horizontal clamping surface beneath bearing strip 16H, with one long grain edge against the reference strip 13, so that the workpiece corner is positioned by dowel pin H. Half-blind pinboard stop 8 is manually positioned against the other long grain edge and tightened within the T-slot, so that the workpiece is captured between the reference strip and the stop, and properly located by dowel pin G (FIG. 10). Rotation of handle 18H presses the bearing strip against the workpiece and secures it tightly for the cutting operation.

Having completed securing the pinboard, the operator positions tailboard stops 9 in reasonable temporary locations to support the end of the tailboard, workpiece D, and inserts the workpiece beneath bearing strip 16V, with one long grain edge against the reference strip 12, and its outside face against the vertical clamping surface. With the workpiece supported. the operator can position and lock the tailboard stops in their proper locations with respect to the workpiece long grain edges, as calculated by the computer. With the stops located so they will not interfere with the inward and outward motions of the cutter, handle 18V can be rotated so that the bearing strip will press against and secure the workpiece for the cutting operation.

Production runs can now be accomplished by initiating the computer program which starts the router and controls the movements of the x-y position table as it carries the cutter first beneath the vertically mounted workpiece to cut the tails, and then to the horizontally mounted workpiece to cut the pins. When the program is completed, the cutter returns to its home position, and the workpiece boards can be quickly removed, flipped and reinserted so the program can be repeated on their opposite ends, and for all remaining workpiece boards.

For through dovetail cutting, an operator inputs data to the computer relating to workpiece dimensions, router bit size and desired dovetail configuration specifics. With this information, the computer calculates joint layout, starting positions, tail board stop locations and the appropriate cutting paths. All cutting operations take place with workpiece boards mounted against the vertical clamping surface. The operator begins with either pinboards or tailboards, but should complete cutting operations on all workpieces of one type before moving on to the next.

Beginning with the tailboard, workpiece D', the operator adjusts the tailboard stops to reasonable temporary locations to support the end of the workpiece board and inserts it beneath bearing strip 16V, with one long grain edge against the reference strip 12, and its inside face against the vertical clamping surface. With the tailboard supported, the operator positions and locks the tailboard stops in their proper locations with respect to the workpiece long grain edges, as calculated by the computer. With the stops located so they will not interfere with the inward and outward motions of the cutter, handle 18V can be rotated so the bearing strip will press against and secure the workpiece for the cutting operation.

A dovetail shaped bit is inserted in the router collet, and its height adjusted so that the length of the tails cut correspond to the thickness of the mating pinboard.

The computer program is then initiated to control movement of the x-y position table as it carries the router through its cutting sequence. Upon its completion, the router returns to home position, and the tailboard is removed, flipped and reinserted so the program can be repeated on its opposite end, and for all remaining tailboards.

When all of the tailboards have been completed, the operator can configure the machine for cutting pinboards, workpieces P'. The computer can perform all calculations necessary for the pinboard cutting sequence using the information previously input for the tailboard cutting sequence. The operator positions the left hand pinboard stop against the reference strip 12 and locks it in place. He then inserts the workpiece P' beneath bearing strip 16V, with its inside face against the vertical clamping surface and one long grain edge against the reference strip 12, and positions the right hand pinboard stop to support it along its end grain edge. When the workpiece is properly positioned, the right hand stop is looked, and handle 18V is rotated so the bearing strip secures it for the cutting operation.

A straight bit is inserted in the router collet and its height adjusted so that the length of the pins cut correspond to the thickness of the mating tailboard.

The computer program can then be initiated to control the movements of the x-y position table as it carries the router through its cutting sequence. Upon completion, the router returns to home position, and the pinboard is removed, flipped and reinserted so the program can be repeated on its opposite end, and for all remaining pinboards.

Other embodiments of the invention in which an exclusive property or privilege is claimed are as follows:

What is claimed is:

1. A method of cutting both mating components for woodworking half-blind dovetail joints comprising the steps of: programming a personal computer control station; mounting a first workpiece board vertically and a second workpiece board horizontally; positioning adjustable locking stops on vertical and horizontal clamping surfaces; clamping the vertically and horizontally mounted first and second workpiece boards; inserting a dovetail shaped bit into the collet of a router cutting means and adjusting its height; initiating a computer program from a personal computer control station that will direct the movements of a router cutting means first to the vertically mounted first workpiece to mill the tails of the joint, then to the horizontally mounted second workpiece to mill the pins of the joint, and return it to its home position.

2. A method of cutting both mating components for woodworking through dovetail joints comprising the steps of: programming a personal computer control station; mounting a first workpiece board vertically; positioning adjustable locking stops on a vertical clamping surface; clamping the vertically mounted first workpiece board; inserting a dovetail shaped bit into the collet of a router cutting means and adjusting its height; initiating a computer program from a personal computer control station that will direct the movements of a router cutting means to the vertically mounted workpiece to mill the tails of the joint, and then return it to its home position; removing the finished first workpiece board from within the vertical clamping means; mounting a second workpiece board within the vertical clamping means; positioning adjustable locking stops on a vertical clamping surface; clamping the vertically mounted second workpiece board; inserting a straight cutter into the collet of a router cutting means and adjusting its height; initiating a computer program from a personal computer control station that will direct the movements of a router cutting means to the vertically mounted second workpiece to mill the pins of the joint, and then return it to its home position.

3. A computer controlled machine for cutting both mating components for woodworking through and half-blind dovetail joints in workpieces suitable for case construction and drawer construction comprising:

vertical and horizontal clamping means supported by a housing and mounted upon a base plate;

a position table capable of x and y axis linear motion mounted upon the base plate and free to move beneath the clamping means;

a router cutting means mounted upon the x-y position table; and adjustable locking stops to accurately position vertically and horizontally mounted workpiece boards for production run setups.

4. A machine according to claim 3 wherein the vertical and horizontal clamping means, housing, base plate, position table and cutting means combination adapted to be mounted upon a bench or table.

5. A machine according to claim 3 adapted to cut both mating components of woodworking through dovetail joints in symmetrical and asymmetrical configurations with computer controlled programmable flexibility to determine size and centerline spacing of pins and tails as well as half-pin widths, said machine lacking guide templates and fixed spindle arrangements.

6. A machine according to claim 3 adapted to cut both mating components of woodworking half-blind dovetail joints can be cut in symmetrical and asymmetrical configurations with computer controlled programmable flexibility to determine size and centerline spacing of pins and tails as well as half-pin widths, said machine lacking guide templates or fixed spindle arrangements.

7. A machine according to claim 3 further comprising stops for a through dovetail and half-blind dovetail tailboard adapted to adjust and lock within a T-slot track milled into the rear face of the vertical clamping surface, whereby workpiece boards of varying widths are held square to the cutting means, said stops adapted to be oriented to avoid interference with the inward and outward motions of the cutting means along its path regardless of the dovetail configuration.

8. A machine according to claim 3 further comprising stops for a through dovetail pinboard adapted to adjust and lock within a T-slot track milled into the front face of the vertical clamping surface, whereby workpiece boards of varying widths are held square to the cutting means without interfering with the movements of the cutting means regardless of the dovetail configuration.

9. A machine according to claim 3 further comprising stops for a half-blind dovetail pinboard adapted to adjust and lock within a T-slot milled into the top face of the horizontal clamping surface, whereby workpiece boards of varying widths are held square to the cutting means without interfering with the movements of the cutting means regardless of the dovetail configuration.

10. A machine according to claim 8 wherein the surface of a right hand through dovetail pinboard stop contacting the edge of the workpiece board is relieved in a manner to avoid pinching of a workpiece disposed between the stop and the zero point reference strip of the vertical clamping surface.

11. A machine according to claim 9 wherein the surface of the half-blind dovetail pinboard stop contacting the edge of the workpiece board is relieved in a manner to avoid pinching of a workpiece disposed between the stop and the zero point reference strip of the horizontal clamping surface.

* * * * *